US010617157B2

(12) United States Patent
West et al.

(10) Patent No.: US 10,617,157 B2
(45) Date of Patent: Apr. 14, 2020

(54) APPAREL TOP WITH A SNOW GAITER HAVING A LIQUID BLADDER

(71) Applicant: Westlife Express, LLC, Gardena, CA (US)

(72) Inventors: Michael Akira West, Manhattan Beach, CA (US); Michael Bretz, Redondo Beach, CA (US)

(73) Assignee: WESTLIFE EXPRESS, LLC, Gardena, CA (US)

( * ) Notice: Subject to any disclaimer, the term of this patent is extended or adjusted under 35 U.S.C. 154(b) by 18 days.

(21) Appl. No.: 15/782,043

(22) Filed: Oct. 12, 2017

(65) Prior Publication Data

US 2019/0110528 A1 Apr. 18, 2019

(51) Int. Cl.
*A41D 3/02* (2006.01)
*A41D 3/00* (2006.01)
(Continued)

(52) U.S. Cl.
CPC ..... *A41D 3/02* (2013.01); *A41D 3/00* (2013.01); *A41D 17/005* (2013.01); *A41D 1/02* (2013.01); *A41D 1/08* (2013.01); *A41D 3/04* (2013.01); *A41D 13/0002* (2013.01); *A41D 13/0012* (2013.01); *A41D 13/0015* (2013.01); *A41D 2200/10* (2013.01); *A41D 2300/20* (2013.01);
(Continued)

(58) Field of Classification Search
CPC ... A41D 3/00; A41D 3/02; A41D 3/04; A41D 17/005; A41D 2300/20; A41D 2400/46; A41D 2600/10; A41D 13/0002; A41D 13/0012; A41D 13/0015; A41D 1/02; A41D 1/08; A41D 2200/10; A45F 2003/166; A45F 3/16; A45F 3/20
USPC ..... 2/93, 69, 108, 247
See application file for complete search history.

(56) References Cited

U.S. PATENT DOCUMENTS 932,608 A * 8/1909 Hodgkins ..... A41D 1/02 2/87
4,526,298 A * 7/1985 Boxer ..... A45F 3/16 222/130
(Continued)

OTHER PUBLICATIONS

Copenheaver, Blaine R., Notification of Transmittal of the International Search Report and the Written Opinion of the International Search Authority, or the Declaration, dated Nov. 30, 2018, 7 pages, PCT/US2018/053194, Alexandria, VA.

*Primary Examiner* — Khaled Annis
*Assistant Examiner* — Dakota Marin
(74) *Attorney, Agent, or Firm* — Stetina Brunda Garred and Brucker

(57) ABSTRACT

An apparel top for use by a user is worn about a user torso and a user waist. The top includes an outer shell portion having first and second panels, a back panel, shell outside and inside surfaces, and a bottom edge. The apparel top includes a snow gaiter having upper and lower gaiter edges, first and second gaiter ends, and gaiter inner and outer surfaces. The upper gaiter edge is attached to the outer shell portion at the shell inside surface and extends along the first front panel, the back panel and the second front panel. The lower gaiter edge is generally positionable about the user waist relative to the user torso with the lower gaiter edge extending away from the user torso. The top includes a liquid bladder sized and configured to be inflated with a liquid. The liquid bladder is attached to the snow gaiter.

13 Claims, 9 Drawing Sheets

(51) Int. Cl.

| | |
|---|---|
| ***A41D 17/00*** | (2006.01) |
| *A41D 13/00* | (2006.01) |
| *A45F 3/16* | (2006.01) |
| *A45F 3/20* | (2006.01) |
| *A41D 1/02* | (2006.01) |
| *A41D 1/08* | (2018.01) |
| *A41D 3/04* | (2006.01) |

(52) U.S. Cl.
CPC ..... *A41D 2400/46* (2013.01); *A41D 2600/10* (2013.01); *A45F 3/16* (2013.01); *A45F 3/20* (2013.01); *A45F 2003/166* (2013.01)

(56) References Cited

U.S. PATENT DOCUMENTS 5,303,425 A * 4/1994 Mele ..... A41D 13/0053 2/102
5,431,308 A 7/1995 Tchen
5,864,880 A * 2/1999 Adam ..... A41D 1/04 2/108
6,220,490 B1 * 4/2001 O'Hara ..... A45F 3/16 2/102
7,497,186 B2 * 3/2009 Dorton ..... A01K 13/006 119/72
7,665,156 B1 * 2/2010 Hewitt ..... A41D 13/0518 2/455
9,359,049 B1 * 6/2016 Alexander ..... B63C 9/115
2002/0124294 A1 * 9/2002 McKenzie ..... A41D 13/0002 2/69
2004/0079775 A1 * 4/2004 Choi ..... A45F 3/20 224/148.2
2004/0128747 A1 * 7/2004 Bumbarger ..... A41D 13/0053 2/458
2005/0022285 A1 2/2005 Berns et al.
2008/0179356 A1 7/2008 Edy et al.
2011/0041234 A1 * 2/2011 Blackford ..... A41D 27/04 2/97
2011/0113524 A1 * 5/2011 Sinder ..... A45F 3/20 2/93
2011/0197332 A1 * 8/2011 Yu ..... A41D 3/00 2/85
2011/0240703 A1 * 10/2011 Tobin ..... A45F 3/16 224/576
2013/0047312 A1 * 2/2013 Wilson ..... A45F 5/02 2/69
2015/0060502 A1 * 3/2015 Murrey ..... A45F 3/20 224/148.2
2016/0135573 A1 * 5/2016 Smith ..... A45F 3/20 222/175

* cited by examiner

APPAREL TOP WITH A SNOW GAITER HAVING A LIQUID BLADDER

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present disclosure relates generally to liquid bladders. More particularly, the present disclosure relates to an apparel top with a snow gaiter having a liquid bladder.

2. Related Art

Proper hydration is essential to the safe practice of a wide variety of recreational, professional and emergency outdoor activities. It is oftentimes desirable to transport a personal water supply while engaged in outdoor activities. In the context of winter sports activities, a thermos or water bottle can be carried in a person's jacket or backpack. Hydration packs in the form of a dedicated backpack having a liquid bladder are also commonly used. Winter sports activities, such as snowboarding, skiing, snowshoeing, or snowmobiling, may typically require brisk movements involving bending and twisting of the torso and swinging of the hips. The placement of a thermos or water bottle in a jacket pocket or the wearing of a backpack holding a thermos or water bottle, or the wearing of a hydration pack during such physical movements may all result in unwanted forces being exerted upon the person and their jacket. This is because liquids, such as water, have a relatively high mass density. This results in a shifting of the person's jacket and/or backpack/hydration pack as the mass of the carried liquid will tend to rotate or shift positions about the person's torso. Such unwanted rotation or shifting can throw a person off-balance, or at the least, be cumbersome and therefore annoying.

Moreover, the use of a thermos or water bottle is undesirable as they may easily be misplaced, dropped or damaged, and it can also be inconvenient for a person to access the thermos or water bottle while engaged in a physical activity. While use of a hydration pack with tubing having a nozzle or bite valve positioned by the person's neck or upper chest avoids these issues, as the person must still wear the hydration pack. The shifting of the hydration pack during physical movements may be mitigated somewhat by tightly securing the hydration pack. However, a tightly secured hydration pack, in additional to winter clothing, is constricting, adds to the overall bulk of the items worn by the person, and impedes free movements of a person's upper torso.

In view of the foregoing, there is a need in the art for an improved method of transporting liquids in the context of winter sports activities.

BRIEF SUMMARY

In accordance with one embodiment, there is provided an apparel top for use by a user worn about a user torso and a user waist. The apparel top includes an outer shell portion having a first front panel, a second front panel, a back panel extending between the first and second front panels, a shell outside surface, a shell inside surface, and a bottom edge.

The shell outside surface is positionable facing away from the user when the apparel top is worn by the user. The shell inside surface is positionable facing towards the user when the apparel top is worn by the user. The bottom edge is defined by the first and second front panels and the back panel and joins the shell inside surface and the shell outside surface. The apparel top further includes an elongate snow gaiter having an upper gaiter edge and an opposing lower gaiter edge, a first gaiter end and an opposing second gaiter end, a gaiter inner surface and a gaiter outer surface. The upper gaiter edge is attached to the outer shell portion at the shell inside surface and extends along the first front panel, the back panel and the second front panel. The lower gaiter edge is generally positionable about the user waist relative to the user torso with the lower gaiter edge extending away from the user torso. The apparel top further includes an elongate liquid bladder being sized and configured to be inflated with a liquid. The liquid bladder is attached to the snow gaiter and extends generally between the first gaiter end and the second gaiter end.

Generally, snow gaiters are also referred to as powder gaiters, snow skirts or powder skirts. The primary function of a snow gaiter is to mitigate a situation where snow or water extends in the space from under the bottom edge of a jacket to one's waist and lower back and torso. For example, this may arise where a rider is aggressively boarding or skiing through high "powder" snow or upon falling while performing such activities. The snow gaiter is contemplated to have a lower edge that is more snuggly fit about the user's waist than in comparison to the bottom edge of an outer shell of a jacket. In this regard, any snow or water that may get under the bottom edge of a jacket would be trapped in the region between the snow gaiter and the inside of the outer shell of the jacket. The present invention advantageously recognizes that the liquid bladder may be attached to or otherwise integrated with the snow gaiter. This allows for the user to carry a personal water or liquid supply without the typical drawbacks of using a thermos or water bottle in a pocket or backpack and/or having to wear a backpack or hydration pack on one's back. The shifting of mass commonly associated with traditional water or liquid transport configurations is mitigated by having the liquid bladder attached to the snow gaiter as the snow gaiter is snuggly fit at the user waist under or inside of the outer shell portion.

According to various embodiments, the apparel top may be a jacket. The snow gaiter may include an inner sleeve. The inner sleeve may be sized and configured to receive the liquid bladder positioned within the inner sleeve and extending between the first and second gaiter ends. The inner sleeve may include a sleeve opening sized and configured to receive the liquid bladder therethrough. The snow gaiter may include a gaiter zipper. The gaiter zipper may include a first zipper half and a second zipper half sized and configured to engage and disengage the first zipper half. The sleeve opening has an open position with the first and second zipper halves being disengaged, and the sleeve opening has a closed position with the first and second zipper halves being engaged. The first and second gaiter ends may be configured to engage each other with the snow gaiter being positionable generally about the user waist. The apparel top may further include a liquid conduit in fluid communication with the liquid bladder with the liquid conduit extending from the liquid bladder along the front panel away from the bottom edge. The apparel top may further include a nozzle attached to the liquid conduit with the liquid conduit disposed between the nozzle and the inflatable balder. The snow gaiter may include an elastic section extending along the lower gaiter edge. The snow gaiter may be removeably attached to the outer shell portion with the upper gaiter edge being removeably attached to the outer shell portion at the shell inside surface and extending along the first front panel, the back panel and the second front panel. The outer shell portion may include gaiter fasteners disposed about the shell inside surface for removeably attaching the snow gaiter to the outer shell portion. In another embodiment, the liquid bladder is the snow gaiter.

In yet another embodiment, there is provided a detachable snow gaiter for use with an apparel top. The snow gaiter includes an elongate snow gaiter body having an upper gaiter edge and an opposing lower gaiter edge, a first gaiter end and an opposing second gaiter end, a gaiter inner surface and a gaiter outer surface. The upper gaiter edge is attachable to the outer shell portion at the shell inside surface and extends along the first front panel, the back panel and the second front panel. The lower gaiter edge is generally positionable about the user waist relative to the user torso with the lower gaiter edge extending away from the user torso. The snow gaiter further includes an elongate liquid bladder being sized and configured to be inflated with a liquid. The liquid bladder is attached to the snow gaiter and extends generally between the first gaiter end and the second gaiter end.

The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

The detailed description set forth below in connection with the appended drawings is intended as a description of certain embodiments of the present disclosure, and is not intended to represent the only forms that may be developed or utilized. The description sets forth the various functions in connection with the illustrated embodiments, but it is to be understood, however, that the same or equivalent functions may be accomplished by different embodiments that are also intended to be encompassed within the scope of the present disclosure. It is further understood that the use of relational terms such as top and bottom, first and second, and the like are used solely to distinguish one entity from another without necessarily requiring or implying any actual such relationship or order between such entities.

Figure 1:
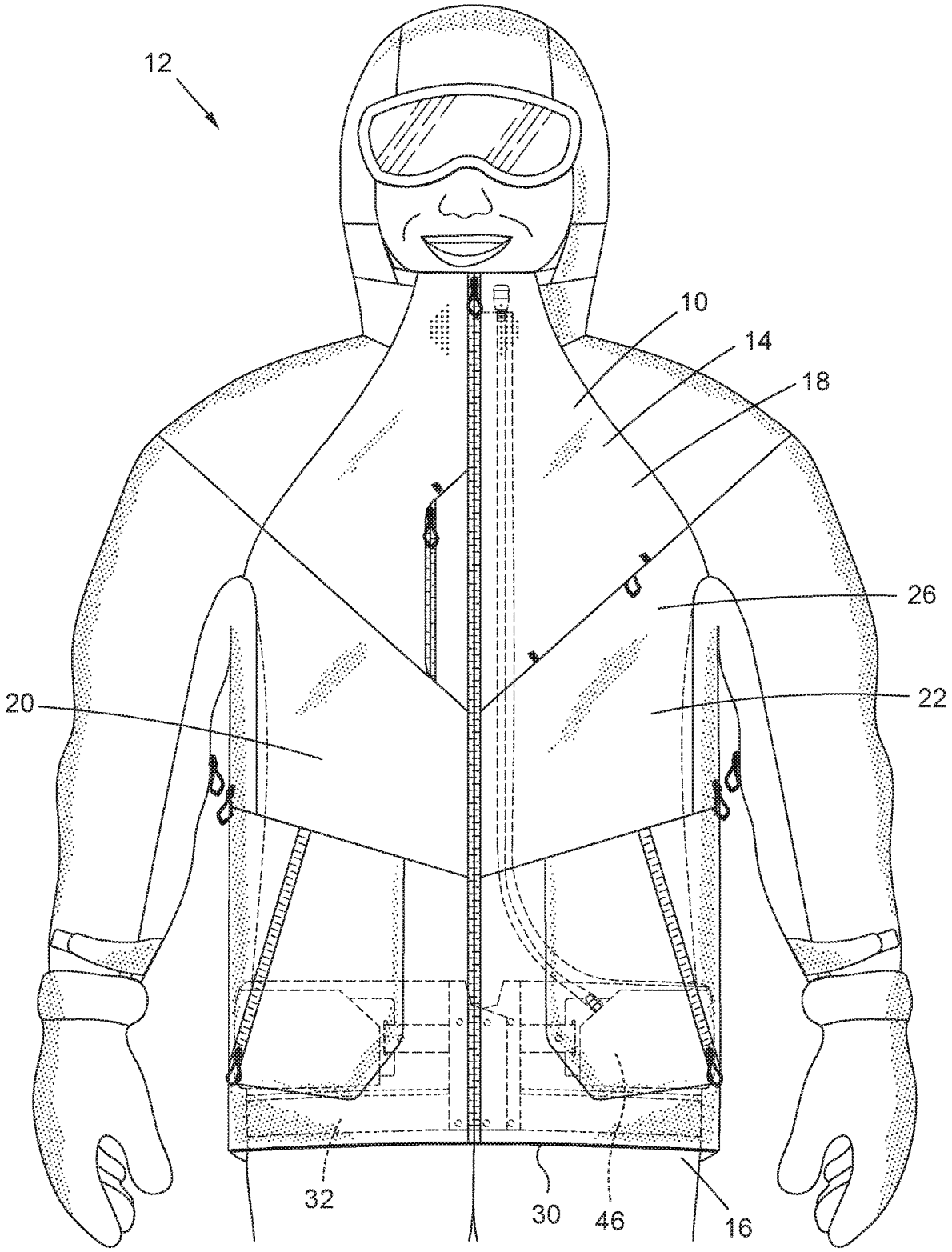
FIG. 1 is a front view of an apparel top including a snow gaiter with an liquid bladder as worn by a user according to an embodiment of the invention.
Figure 2:
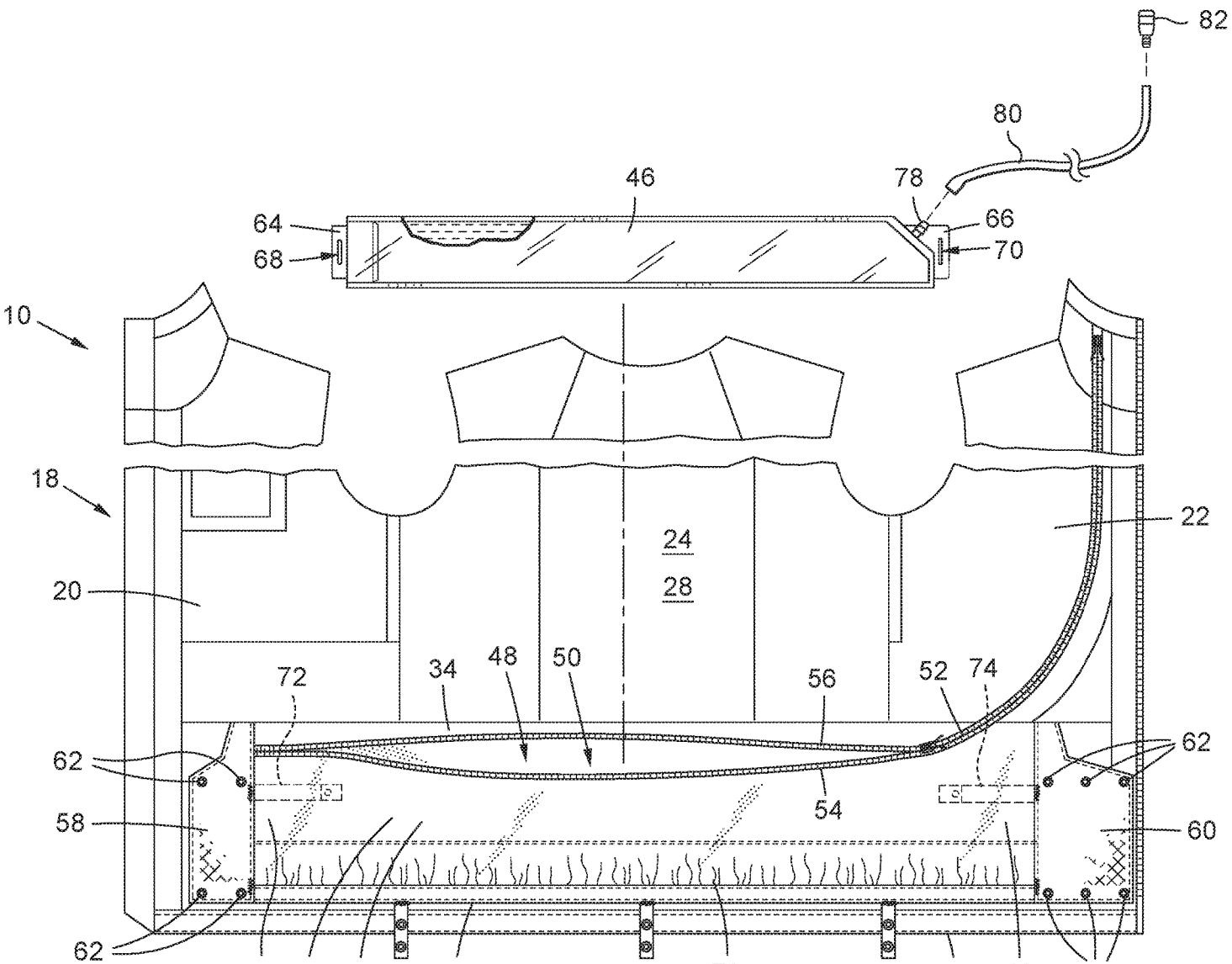
FIG. 2 is a front view of a portion of the apparel top (without arm or hood portions) as depicted with the apparel top in an open configuration and with a sleeve opening is in an open position and the liquid bladder, a liquid conduit and a nozzle shown in exploded view from the snow gaiter.
Figure 3:
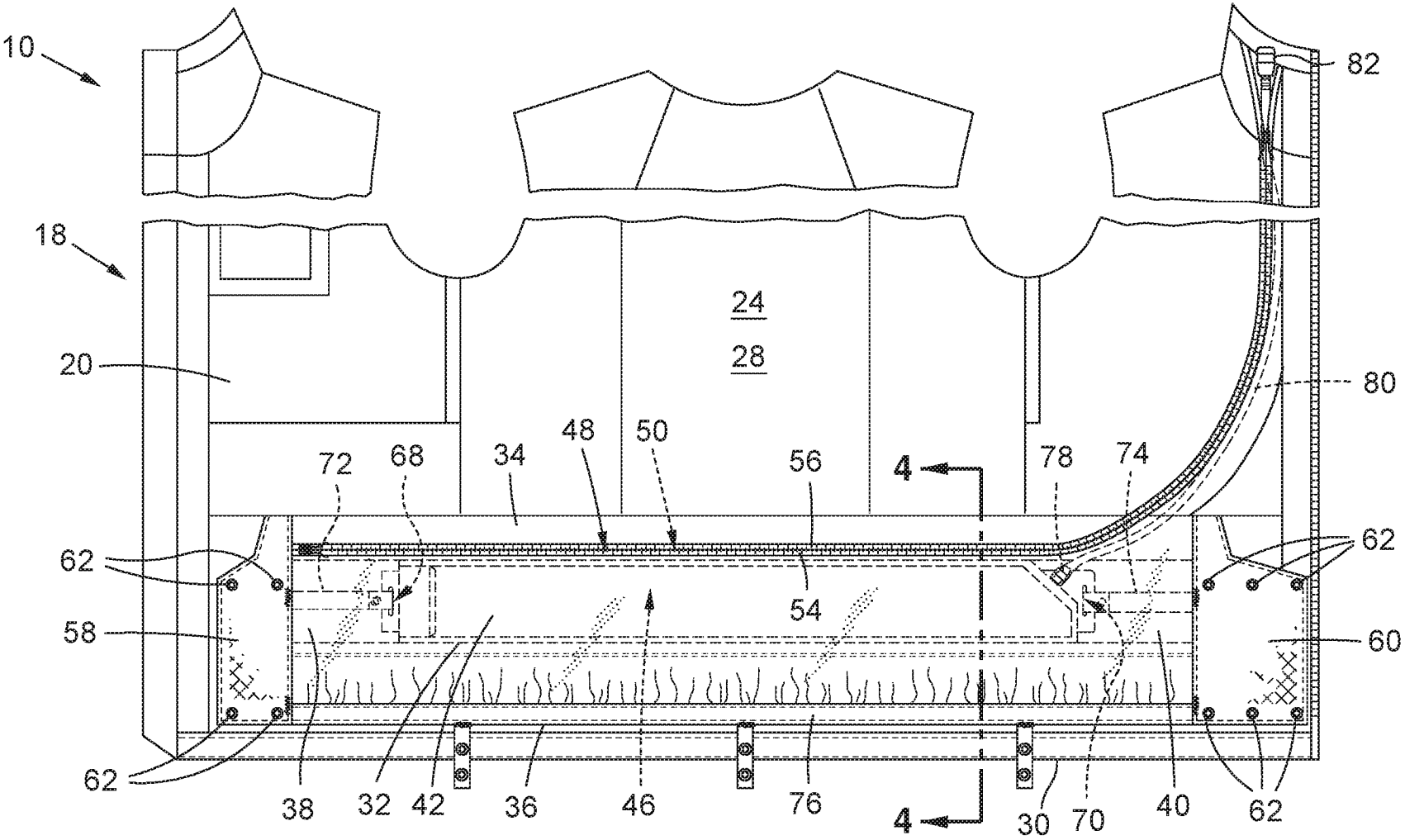
FIG. 3 is a front view of the portion of the apparel top of FIG. 2 with the sleeve opening is in a closed position and the liquid bladder, the liquid conduit and the nozzle assembled with the snow gaiter.
Figure 4:
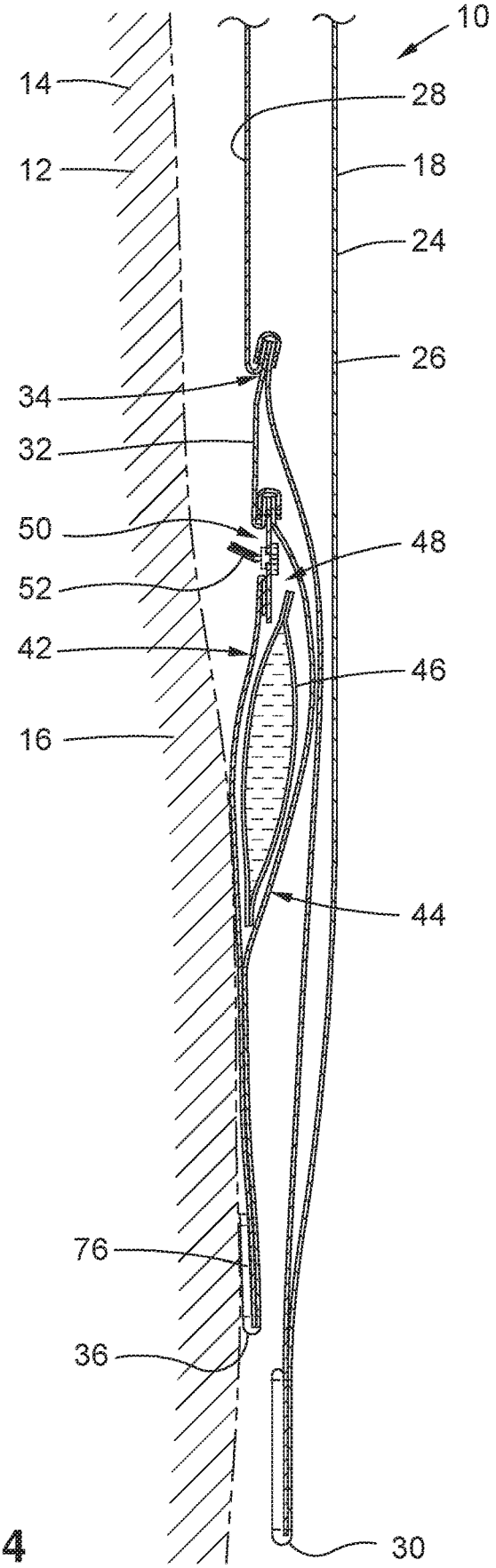
FIG. 4 is a cross-sectional view of a portion of the apparel top along axis 4-4 of FIG. 3.

Referring now to FIG. 1, there is depicted a front view of an apparel top 10 as worn by a user 12 about a user torso 14 and a user waist 16 according to various aspects of the inventions described herein. Referring additionally to FIG. 2, there is depicted a front view of a portion of the apparel top 10 (without arm or hood portions) as depicted with the apparel top 10 in an open configuration and with a sleeve opening 50 in an open position and an elongate liquid bladder 46, a liquid conduit 80 and a nozzle 82 shown in exploded view from a snow gaiter 32. FIG. 3 is the front view of the portion of the apparel top 10 of FIG. 2 with the sleeve opening 50 in a closed position and the liquid bladder 46, the liquid conduit 80 and the nozzle 82 assembled with the snow gaiter 32. FIG. 4 is a cross-sectional view of a portion of the apparel top 10 along axis 4-4 of FIG. 3.

According to an embodiment of the invention, the apparel top 10 includes an outer shell portion 18 having a first front panel 20, a second front panel 22, a back panel 24 extending between the first and second front panels 20, 22, a shell outside surface 26, a shell inside surface 28, and a bottom edge 30. The shell outside surface 26 is positionable facing away from the user 12 when the apparel top 10 is worn by the user 12. The shell inside surface 28 is positionable facing towards the user 12 when the apparel top 10 is worn by the user 12. The bottom edge 30 is defined by the first and second front panels 20, 22 and the back panel 24 and joining the shell inside surface 28 and the shell outside surface 26. The apparel top 10 further includes the elongate snow gaiter 32 having an upper gaiter edge 34 and an opposing lower gaiter edge 36, a first gaiter end 38 and an opposing second gaiter end 40, a gaiter inner surface 42 and a gaiter outer surface 44. The upper gaiter edge 34 is attached to the outer shell portion 18 at the shell inside surface 28 and extends along the first front panel 20, the back panel 24 and the second front panel 22. The lower gaiter edge 36 is generally positionable about the user waist 16 relative to the user torso 14 with the lower gaiter edge 36 extending away from the user torso 14. The apparel top 10 further includes the elongate liquid bladder 46 which is sized and configured to be inflated with a liquid, such as water. The liquid bladder 46 is attached to the snow gaiter 32 and extends generally between the first gaiter end 38 and the second gaiter end 40.

Generally, snow gaiters are also referred to as powder gaiters, snow skirts or powder skirts. The primary function of a snow gaiter is to mitigate a situation where snow or water extends in the space from under the bottom edge of a jacket to one's waist and lower back and torso. For example, this may arise where a rider is aggressively boarding or skiing through high "powder" snow or upon falling while performing such activities. The snow gaiter is contemplated to have a lower edge that is more snuggly fit about the user's waist than in comparison to the bottom edge of an outer shell of a jacket. In this regard, any snow or water that may get under the bottom edge of a jacket would be trapped in the region between the snow gaiter and the inside of the outer shell of the jacket. The present invention advantageously recognizes that the liquid bladder 46 may be attached to or otherwise integrated with the snow gaiter 32. This allows for the user 12 to carry a personal water or liquid supply without the typical drawbacks or using a thermos or water bottle in a pocket or backpack and/or having to wear a backpack or hydration pack on one's back. The shifting of mass commonly associated with traditional water or liquid transport configurations is mitigated by having the liquid bladder 46 attached to or otherwise integrated with the snow gaiter 32, as the snow gaiter 32 is snuggly fit at the user waist 16 under or inside of the outer shell portion 18.

According to various embodiments, the apparel top 10 may be a jacket, such as a snowboarding or ski jacket. However, other articles of clothing are contemplated such as windbreakers, parkas, vests, and the like, that are worn about a user torso 14 and user waist 16.

The snow gaiter 32 may include an inner sleeve 48. The inner sleeve 48 may be sized and configured to receive the liquid bladder 46 positioned within the inner sleeve 46 and extending between the first and second gaiter ends 38, 40. The inner sleeve 48 may include the sleeve opening 50 sized and configured to receive the liquid bladder 46 therethrough. The inner sleeve 48 creates a space for the liquid bladder 46 to be attached to the snow gaiter 32. The snow gaiter 32 may include a gaiter zipper 52. The gaiter zipper 52 may include a first zipper half 54 and a second zipper half 56 sized and configured to engage and disengage the first zipper half 54. The sleeve opening 50 has an open position with the first and second zipper halves 54, 56 being disengaged, and the sleeve opening 50 has a closed position with the first and second zipper halves 54, 56 being engaged. This allows for the liquid bladder 46 to be conveniently placed in and taken out of the snow gaiter 32. Other closure configurations for the inner sleeve 46 may be utilized such as those selected from those well known to one of ordinary skill in the art, such as buttons, and hook and loop fasteners. In another arrangement, a small slit may be provided in the material of the snow gaiter 32 where the overlapping material may allow insertion of the liquid bladder 46 while providing a means to maintain some form of closure to mitigate against the liquid bladder 46 from coming out of the inner sleeve 46.

The first and second gaiter ends 38, 40 may be configured to engage each other with the snow gaiter 32 being positionable generally about the user waist 16. A first flap 58 may be disposed at the first gaiter end 38, and a second flap 60 may be disposed at the second gaiter end 40. Each of the first and second flaps 58, 60 may include various snap fasteners 62. The snap fasteners 62 of the first flap 58 are sized and configured to engage the snap fasteners 62 of the second flap 60 for allowing the first and second gaiter ends 38, 40 to be detachably engaged to each other about the user waist 16. Use of multiple pairs of snap fasteners 62 disposed at different locations lengthwise along the snow gaiter 32 allows the user 12 adjust the effective length of the snow gaiter 32 about the user waist 16 for differing degrees of sizing and snugness. Other means for securing the first and second gaiter ends 38, 40 may be utilized such as those selected from those well known to one of ordinary skill in the art, such as buttons, a hood, loop fasteners, and buckles. To further facilitate a snug fit of the snow gaiter 32 about the user waist 16, the snow gaiter 32 may include an elastic section 76 extending along the lower gaiter edge 36.

As mentioned above the liquid bladder 46 is attached to the snow gaiter 32. In this context, the term "attached to" simply refers to the liquid bladder 46 maintaining a physical spatial relationship to the snow gaiter 32. In this embodiment the liquid bladder 46 is contained within the inner sleeve 48 and therefore considered attached to the snow gaiter 32. To facilitate further attachment and means to secure the positioning of the liquid bladder 46 within the inner sleeve 48, the liquid bladder 46 may have a first attachment portion 64 disposed at the first gaiter end 38 and a second attachment portion 66 disposed at the second gaiter end 40. The first attachment portion 64 includes a first slit 68, and the second attachment portion 66 includes a second slit 70. First and second snap tabs 72, 74 may be disposed within the inner sleeve 48 with the first snap tab 72 at the first gaiter end 38 and the second snap tab 74 at the second gaiter end 40. The first snap tab 72 may be threaded through the first slit 68 to detachably attach the first attachment portion 64 at the first gaiter end 38. Likewise, the second snap tab 74 may be threaded through the second slit 70 to detachably attach the second attachment portion 66 at the second gaiter end 40.

The liquid bladder 46 may have an outlet port 78. The outlet port 78 is configured to allow water or other liquids to flow into and from within the liquid bladder 46. The apparel top 10 may further include a liquid conduit 80 in fluid communication with the liquid bladder 46 with the liquid conduit 80 extending from the liquid bladder 46 along second front panel 22 away from the bottom edge 30. The liquid conduit 80 may be sized and configured to engage the outlet port 78. The apparel top 10 may further include a nozzle 82 attached to the liquid conduit 80 with the liquid conduit 80 disposed between the nozzle 82 and the inflatable bladder 46. It is contemplated that the nozzle 82 may be conveniently positioned adjacent the neck or upper chest of the user 12. In this particular embodiment, the gaiter zipper 52 extends from the snow gaiter 32 and continues up along the second front panel 22. This conveniently allows the fluid conduit 80 to be concealed and tucked away with just the nozzle 82 exposed for use by the user 12. The nozzle 82 may be constructed with a bite valve to facilitate an ease of use by the user 12. This is particularly useful where the user 12 is able to access water or liquid within the fluid bladder 46 without the need to take off any gloves of the user 12.

It is contemplated that the various components of the apparel top 10, the snow gaiter 32 and the liquid bladder 46 (as discussed above, and as discuss in the various embodiments below) may be constructed of materials and according to those manufacturing processes that are well known to one of ordinary skill in the art.

Figure 5:
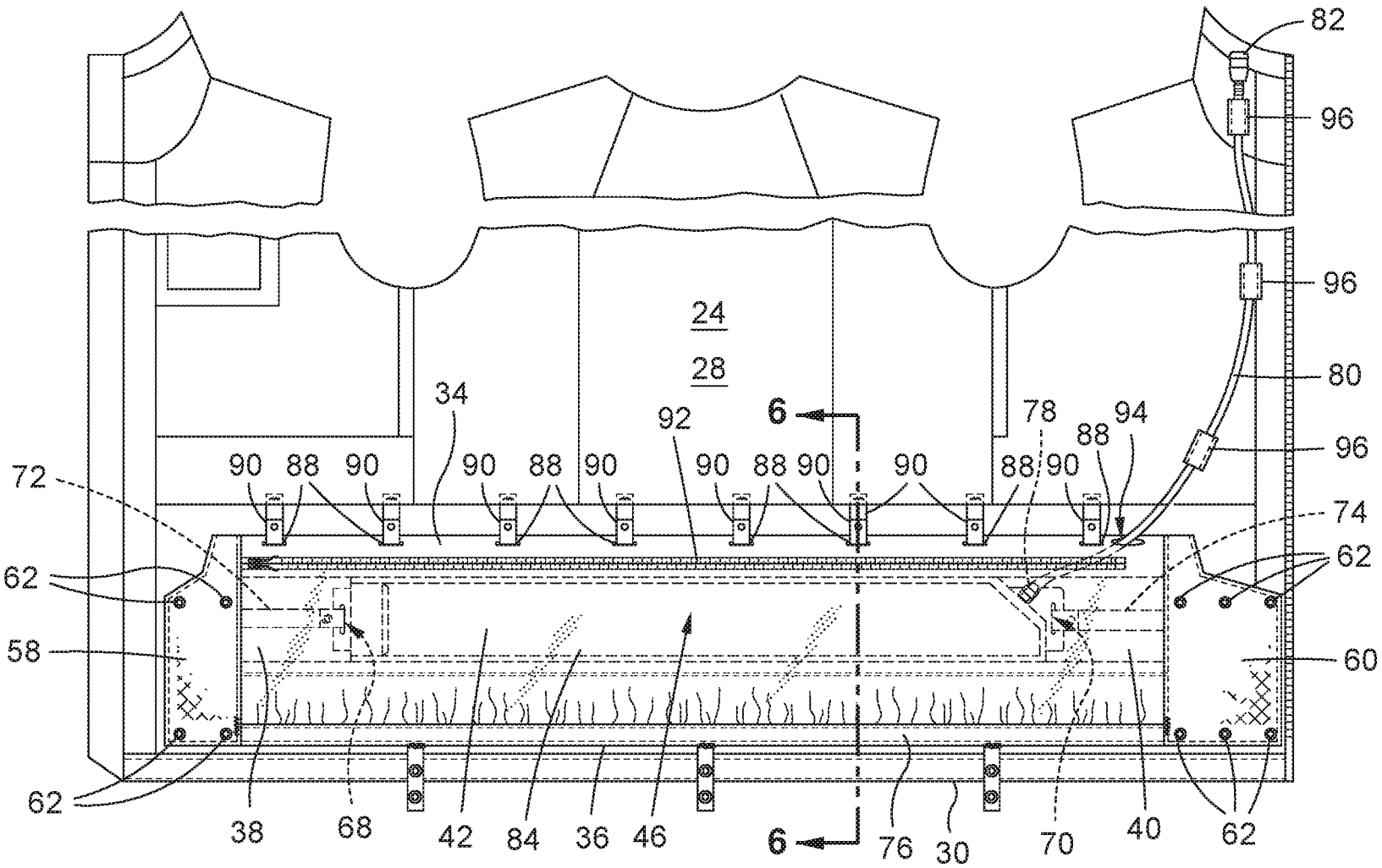
FIG. 5 is a front view of a portion of an apparel top according to another embodiment with a detachable snow gaiter.
Figure 6:
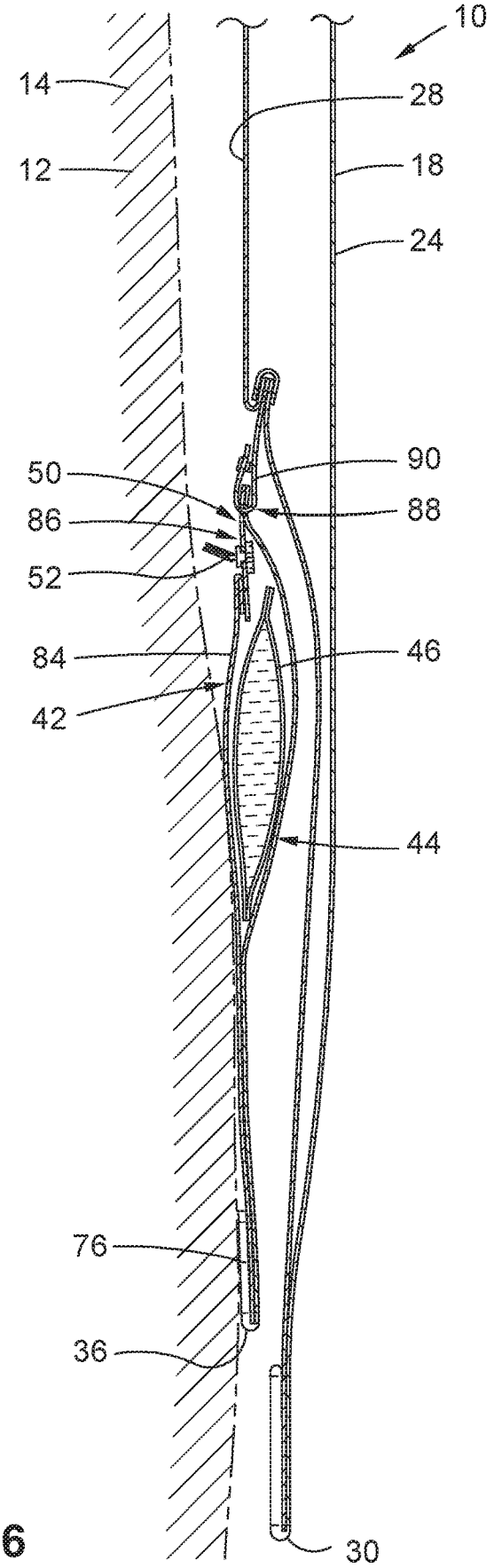
FIG. 6 is a cross-sectional view of the portion of the apparel top along axis 6-6 of FIG. 5.

In accordance with another embodiment, referring now to FIGS. 5 and 6, there is provided the apparel top 10 including a detachable snow gaiter 84. This embodiment is similar as the one previously discussed in the context of the snow gaiter 32, however, with several differences. In this regard, the same terms are intended to refer to the same structures except as otherwise discussed. FIG. 5 is a front view of a portion of the apparel top 10 according to another embodiment with the detachable snow gaiter 84. FIG. 6 is a cross-sectional view of the portion of the apparel top 10 along axis 6-6 of FIG. 5.

The snow gaiter 84 may be removeably attached to the outer shell portion 18 with the upper gaiter edge 86 being removeably attached to the outer shell portion 18 at the shell inside surface 28 and extending along the first front panel 20, the back panel 24 and the second front panel 22. In this embodiment, the outer shell portion 18 may include gaiter fasteners 90 disposed about the shell inside surface 28 for removeably attaching the snow gaiter 84 to the outer shell portion 18. The gaiter fasteners 90 may take the form of tabs with snaps. The snow gaiter 84 may include attachment slits 88 corresponding to each of the gaiter fasteners 90. The gaiter fasteners 90 may be threaded through a corresponding attachment slit 88 for attachment of the snow gaiter 84. Other means for removeably attaching the snow gaiter 84 to the shell inside surface 28 may be utilized such as those selected from those well known to one of ordinary skill in the art, such as a zipper, buttons, or hook and loop fasteners. In the embodiment depicted, the snow gaiter 84 may include a gaiter zipper 92. The gaiter zipper 92 allows for the liquid bladder 46 to be removably placed within the snow gaiter 84. The snow gaiter 84 may include a though hole 94 to allow the fluid conduit 80 to be threaded therethrough from within the snow gaiter 84 towards and adjacent the second front panel 22. Conduit loops 96 may be attached to the outer shell portion 18 at the shell inside surface 28 along the second front panel 22 for securing the fluid conduit 80.

Figure 7:
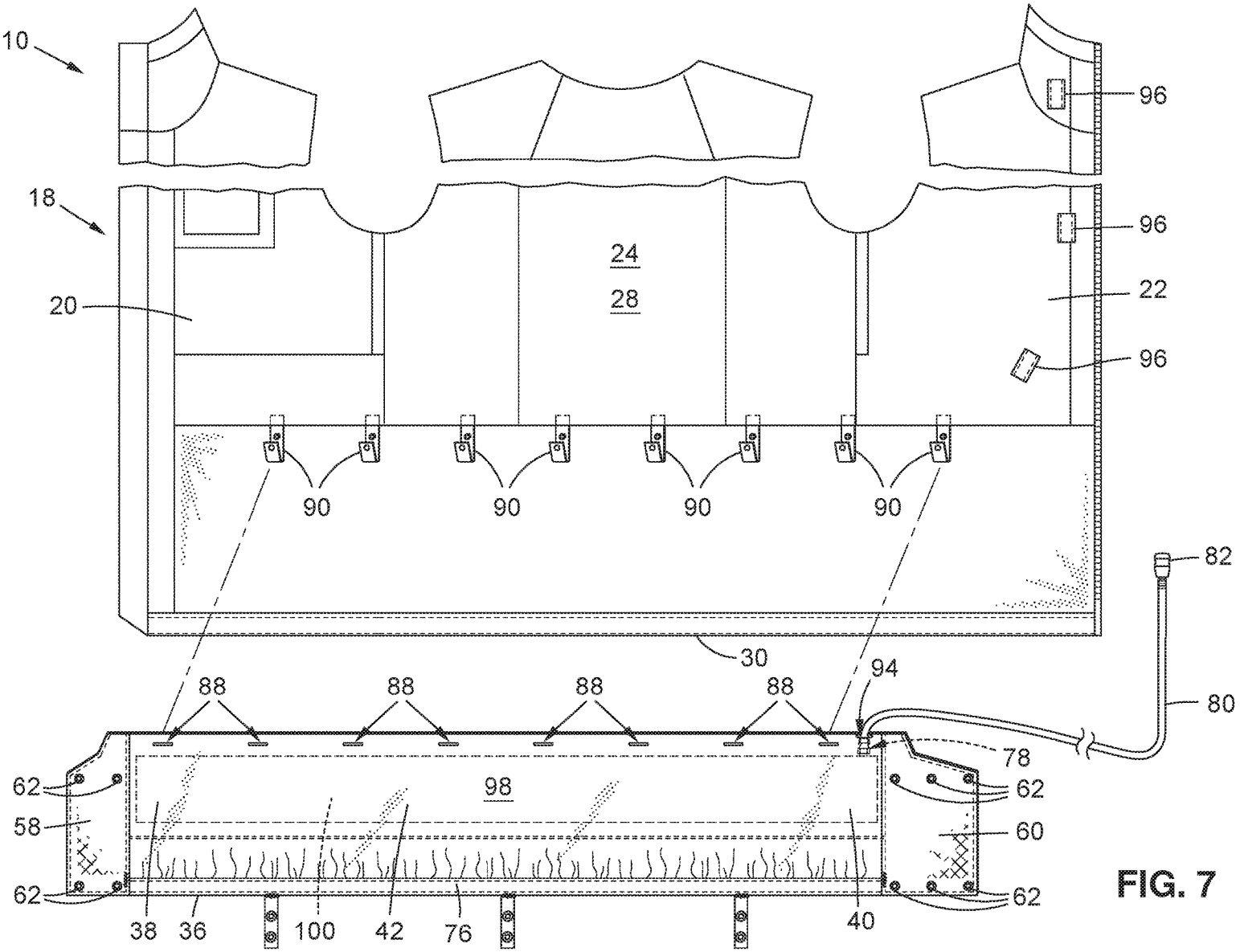
FIG. 7 is a front view of a portion of an apparel top according to another embodiment with a detachable snow gaiter with an integrated inflatable liquid bladder detached from the apparel top.
Figure 8:
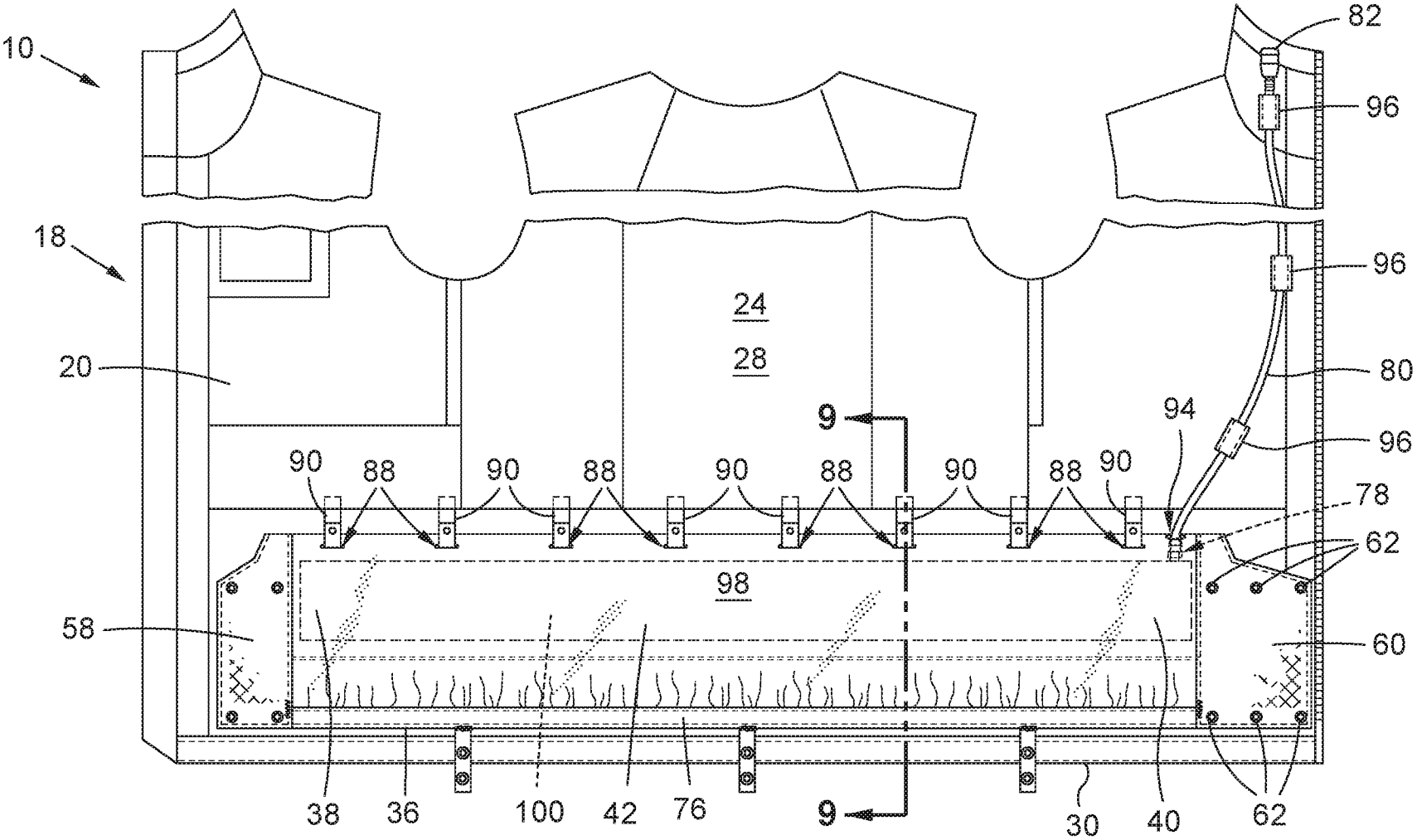
FIG. 8 is a front view of the portion of the apparel top of FIG. 7 with the snow gaiter assembled with the apparel top.
Figure 9:
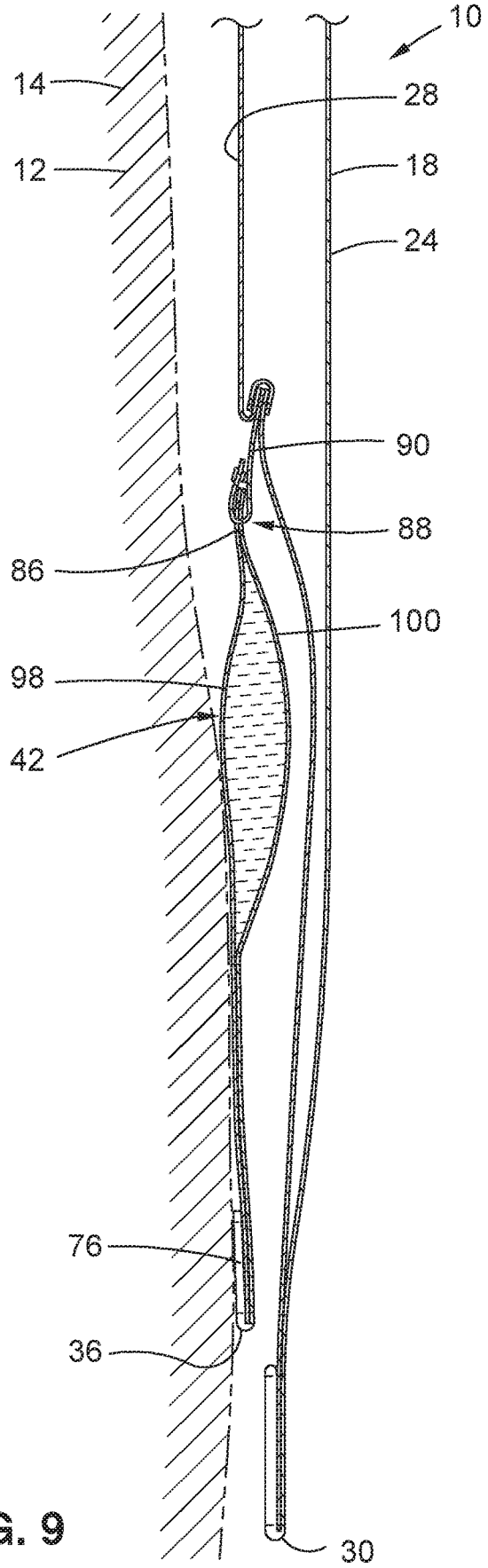
FIG. 9 is a cross-sectional view of the portion of the apparel top along axis 9-9 of FIG. 8.

In accordance with another embodiment, referring now to FIGS. 7, 8 and 9, there is provided the apparel top 10 including a detachable snow gaiter 98. This embodiment is similar as the one previously discussed in the context of the snow gaiter 84, however, with several differences. In this regard, the same terms are intended to refer to the same structures except as otherwise discussed. FIG. 7 is a front view of a portion of an apparel top 10 according to another embodiment with the detachable snow gaiter 98 with an integrated inflatable liquid bladder 100 as shown detached from the apparel top 10. FIG. 8 is a front view of the portion of the apparel top of FIG. 7 with the snow gaiter 98 assembled with the apparel top 10. FIG. 9 is a cross-sectional view of the portion of the apparel top 10 along axis 9-9 of FIG. 8. In this embodiment, it is contemplated that the liquid bladder 100 is the snow gaiter 98 itself. In this regard the liquid bladder 100 is not constructed to be removed from the snow gaiter 98, as is the case in embodiments of the liquid bladder 46 with the snow gaiters 32, 84 as described above.

The particulars shown herein are by way of example only for purposes of illustrative discussion, and are presented in the cause of providing what is believed to be the most useful and readily understood description of the principles and conceptual aspects of the various embodiments set forth in the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. An apparel top for use by a user worn about a user torso and user waist, the apparel top comprising:

an outer shell portion having a first front panel, a second front panel, a back panel extending between the first and second front panels, a shell outside surface, a shell inside surface, and a bottom edge, the shell outside surface positionable facing away from the user with the apparel top being worn by the user, the shell inside surface positionable facing towards the user with the apparel top being worn by the user, the bottom edge being defined by the first and second front panels and the back panel and joining the shell inside surface and the shell outside surface;

an elongate snow gaiter having an upper gaiter edge and an opposing lower gaiter edge, a first gaiter end and an opposing second gaiter end, a gaiter inner surface and a gaiter outer surface, the upper gaiter edge being attached to the outer shell portion at the shell inside surface and extending along the first front panel, the back panel and the second front panel, the lower gaiter edge not being directly attached to the outer shell portion adjacent the bottom edge of the outer shell portion, the lower gaiter edge being generally positionable about the user waist relative to the user torso with the lower gaiter edge adapted to be extending away from the user torso, the first and second gaiter ends being configured to engage each other with the snow gaiter being positionable generally about the user waist; and an elongate liquid bladder being sized and configured to be inflated with a liquid, the liquid bladder attached to the snow gaiter and extending generally between the first gaiter end and the second gaiter end, the liquid bladder having first and second bladder ends, the first and second bladder ends being releaseably attachable to the snow gaiter respectively adjacent the first and second gaiter ends.

2. The apparel top of claim 1 wherein the apparel top is a jacket.

3. The apparel top of claim 1 wherein the snow gaiter includes an inner sleeve, the inner sleeve is sized and configured to receive the liquid bladder positioned within the inner sleeve and extending between the first and second gaiter ends.

4. The apparel top of claim 3 wherein the inner sleeve includes a sleeve opening sized and configured to receive the liquid bladder there through.

5. The apparel top of claim 4 wherein the snow gaiter includes a gaiter zipper, the gaiter zipper includes a first zipper half and a second zipper half sized and configured to engage and disengage the first zipper half, the sleeve opening having an open position with the first and second zipper halves being disengaged, the sleeve opening having a closed position with the first and second zipper halves being engaged.

6. The apparel top of claim 1 further includes a liquid conduit in fluid communication with the liquid bladder with the liquid conduit extending from the liquid bladder along the front panel away from the bottom edge.

7. The apparel top of claim 6 further includes a nozzle attached to the liquid conduit with the liquid conduit disposed between the nozzle and the liquid bladder.

8. The apparel top of claim 1 wherein the snow gaiter includes an elastic section extending along the lower gaiter edge.

9. The apparel top of claim 1 wherein the snow gaiter is removeably attached to the outer shell portion with the upper gaiter edge being removebably attached to the outer shell portion at the shell inside surface and extending along the first front panel, the back panel and the second front panel.

10. The apparel top of claim 9, wherein the outer shell portion includes gaiter fasteners disposed about the shell inside surface for removeably attaching the snow gaiter to the outer shell portion.

11. The apparel top of claim 9 wherein the inner sleeve includes a sleeve opening sized and configured to receive the liquid bladder there through.

12. A detachable snow gaiter for use with an apparel top worn by a user about a user torso and user waist, the apparel top having an outer shell portion, the outer shell portion having a first front panel, a second front panel, a back panel extending between the first and second front panels, a shell outside surface, a shell inside surface, and a bottom edge, the shell outside surface positionable facing away from the user with the apparel top being worn by the user, the shell inside surface positionable facing towards the user with the apparel top being worn by the user, the bottom edge being defined by the first and second front panels and the back panel and joining the shell inside surface and the shell outside surface, the snow gaiter comprising:

an elongate snow gaiter body having an upper gaiter edge and an opposing lower gaiter edge, a first gaiter end and an opposing second gaiter end, a gaiter inner surface and a gaiter outer surface, the upper gaiter edge being attachable to the outer shell portion at the shell inside surface and extending along the first front panel, the back panel and the second front panel, the lower gaiter edge not being directly attached to the outer shell portion adjacent the bottom edge of the outer shell portion, the lower gaiter edge being generally positionable about the user waist relative to the user torso with the lower gaiter edge adapted to be extending away from the user torso, the first and second gaiter ends being configured to engage each other with the snow gaiter being positionable generally about the user waist; and an elongate liquid bladder being sized and configured to be inflated with a liquid, the liquid bladder attached to the snow gaiter and extending generally between the first gaiter end and the second gaiter end, the liquid bladder having first and second bladder ends, the first and second bladder ends being releaseably attachable to the snow gaiter respectively adjacent the first and second gaiter ends.

13. The snow gaiter of claim 12 wherein the upper gaiter edge is removebably attached to the outer shell portion at the shell inside surface and extends along the first front panel, the back panel and the second front panel.

* * * * *